US009498677B2

(12) United States Patent
Raniere

(10) Patent No.: US 9,498,677 B2
(45) Date of Patent: Nov. 22, 2016

(54) RESISTANCE TRAINING DEVICE

(71) Applicant: FIRST PRINCIPLES, INC., Albany, NY (US)

(72) Inventor: Keith A. Raniere, Clifton Park, NY (US)

(73) Assignee: FIRST PRINCIPLES, INC., Albany, NY (US)

( * ) Notice: Subject to any disclaimer, the term of this patent is extended or adjusted under 35 U.S.C. 154(b) by 0 days.

(21) Appl. No.: 14/967,567

(22) Filed: Dec. 14, 2015

(65) Prior Publication Data

US 2016/0096065 A1 Apr. 7, 2016

Related U.S. Application Data

(62) Division of application No. 13/841,627, filed on Mar. 15, 2013, now Pat. No. 9,216,318.

(51) Int. Cl.

| | |
|---|---|
| ***A63B 23/14*** | (2006.01) |
| ***A63B 23/16*** | (2006.01) |
| ***A63B 21/16*** | (2006.01) |
| ***A63B 21/00*** | (2006.01) |
| ***A63B 21/02*** | (2006.01) |
| ***A63B 21/05*** | (2006.01) |
| ***A63B 23/035*** | (2006.01) |
| ***A63F 7/06*** | (2006.01) |

(Continued)

(52) U.S. Cl.

CPC ..... *A63B 23/14* (2013.01); *A63B 21/02* (2013.01); *A63B 21/023* (2013.01); *A63B 21/05* (2013.01); *A63B 21/055* (2013.01); *A63B 21/15* (2013.01); *A63B 21/151* (2013.01); *A63B 21/157* (2013.01); *A63B 21/16* (2013.01); *A63B 21/4023* (2015.10); *A63B 21/4035* (2015.10); *A63B 23/03541* (2013.01); *A63B 23/16* (2013.01); *A63F 7/0616* (2013.01); *A63F 7/0672* (2013.01); *A63B 21/4049* (2015.10); *A63B 2023/003* (2013.01); *A63B 2210/50* (2013.01)

(58) Field of Classification Search

CPC ..... A63B 23/14; A63B 23/12; A63B 23/02; A63B 23/00; A63B 21/012; A63B 21/015

USPC ..... 482/44–50, 110

See application file for complete search history.

(56) References Cited

U.S. PATENT DOCUMENTS

| | | | |
|---|---|---|---|
| 1,788,210 | A | 1/1931 | Staar |
| 2,832,596 | A | 4/1958 | Brown |

(Continued)

*Primary Examiner* — Stephen Crow
*Assistant Examiner* — Garrett Atkinson
(74) *Attorney, Agent, or Firm* — Schmeiser, Olsen & Watts, LLP

(57) ABSTRACT

A game table for resistance training including walls defining a game space of the game table, wherein at least one of the plurality of walls is a side wall having a plurality of non-uniform diameter openings, a plurality of game table rods extending through the plurality of non-uniform diameter openings, wherein at least one foosmen is attached to each of the plurality of game table rods, and a resistance article at least partially wrapped around at least one of the plurality of game table rods, the resistance article having a tapered thickness, wherein the non-uniform diameter openings of the side wall is defined by a first section and a second section, the first section having a constant radius from a center point of the non-uniform opening, and the second section having a smaller radius than the constant radius of the first section, is provided. A resistance device is also provided.

16 Claims, 10 Drawing Sheets

(51) Int. Cl.
*A63B 21/055* (2006.01)
*A63B 23/00* (2006.01)

(56) References Cited

U.S. PATENT DOCUMENTS

| | | | | | |
|---|---|---|---|---|---|
| 3,574,350 | A | | 4/1971 | May | |
| 4,127,269 | A | | 11/1978 | Rest | |
| 4,382,598 | A | | 5/1983 | McCloud | |
| 4,444,393 | A | | 4/1984 | Brankovic | |
| 5,046,727 | A | | 9/1991 | Wilkinson et al. | |
| 5,071,137 | A | | 12/1991 | McCloud | |
| 5,072,880 | A | | 12/1991 | McCloud | |
| 5,167,596 | A | * | 12/1992 | Ferber | A63B 21/0004 482/114 |
| 5,228,356 | A | | 7/1993 | Chuang | |
| 5,445,581 | A | * | 8/1995 | Ferber | A63B 21/015 482/115 |
| 5,490,817 | A | * | 2/1996 | Stander | A63B 23/14 482/127 |
| 6,464,220 | B1 | | 10/2002 | Tsai | |
| 6,663,108 | B2 | | 12/2003 | Makhoul | |
| 6,851,673 | B2 | | 2/2005 | Tsai | |
| 7,458,579 | B2 | | 12/2008 | Tsai et al. | |
| 9,180,339 | B2 | | 11/2015 | Raniere | |
| 9,216,318 | B2 | | 12/2015 | Raniere | |
| 2006/0043667 | A1 | * | 3/2006 | Schlaefer | A63F 7/06 273/108.1 |
| 2006/0091600 | A1 | | 5/2006 | Schlaefer | |
| 2006/0128534 | A1 | * | 6/2006 | Roque | A63B 15/00 482/82 |
| 2006/0178178 | A1 | * | 8/2006 | Nebel | A63F 7/0672 463/4 |
| 2010/0267523 | A1 | | 10/2010 | Wilkinson | |
| 2013/0273986 | A1 | * | 10/2013 | Arnone | A63F 7/0672 463/7 |

* cited by examiner

RESISTANCE TRAINING DEVICE

This application is a divisional application of U.S. application Ser. No. 13/841,627, filed Mar. 15, 2013, and entitled, "Resistance Training Device and Method of Use Thereof" Now U.S. Pat. No. 9,216,318.

FIELD OF TECHNOLOGY

The following relates to a resistance training device and more specifically to embodiments of resistance training device for use with a game table.

BACKGROUND

Foosball is a wildly popular game that is played on a game table by controlling one or more rods within a game space in an axial direction to position the foosmen at various locations across a width of the game table. To strike the ball in play, a user rotates the rod when the ball is proximate the foosmen attached to the rod. The higher the acceleration of the rod when the user rotates the rod to strike the ball, the larger the force exerted onto the ball, which results in the ball moving across the game table towards a goal at a faster speed. This is advantageous to the game of foosball because the greater the shot speed of the ball, the less chance a defender can reposition the foosmen to block the shot. Increasing the shot speed of the ball requires improving a torque output generated by the user's body when rotating the foosball handle attached to the rod and the user's muscle memory when taking a foosball shot.

Thus, a need exists for an apparatus and method for improving a torque output through resistance training.

SUMMARY

A first general aspect relates to a resistance training device comprising a mounting device, the mounting device configured to removably mount onto a game table, a resistance article configured to be operably attached to a game table rod that extends into a game space of the game table, the resistance article having a thickness that tapers from a minimum thickness to a maximum thickness, wherein the resistance article extends through a non-uniform opening of the mounting device, wherein a resistance is gradually increased during rotation of the resistance article.

A second general aspect relates to a resistance training device comprising a mounting device having a first side and a second side, the first side separated from the second side by a separation portion, the separation portion spanning a thickness of a wall of a game table when the mounting device is operably attached to the game table, an elongated opening on the first side of the mounting device, the elongated opening having a first portion and a second portion, the first portion starting at a bottom edge of the first side of the mounting device and defined by a separation larger than a diameter of a game table rod, the second portion defined by a rounded opening having a non-uniform diameter, and a resistance article configured to be at least partially wrapped around the game table rod, the resistance article having a tapered thickness.

A third general aspect relates to a game table for resistance training comprising a plurality of walls defining a game space of the game table, wherein at least one of the plurality of walls is a side wall having a plurality of non-uniform diameter openings, a plurality of game table rods extending through the plurality of non-uniform diameter openings, wherein at least one foosmen is attached to each of the plurality of game table rods, and a resistance article at least partially wrapped around at least one of the plurality of game table rods, the resistance article having a tapered thickness, wherein the non-uniform diameter openings of the side wall is defined by a first section and a second section, the first section having a constant radius from a center point of the non-uniform opening, and the second section having a smaller radius than the constant radius of the first section.

A fourth general aspect relates to a resistance training device comprising at least one wall having a plurality of openings configured to receive a rod structure, the rod structure having an engagement structure, wherein a portion of the at least one side wall radially inwardly extends into at least one of the plurality of openings, and a resistance article disposed between an inner surface of the at least one wall and an outer surface of the rod structure, the resistance article having a first end and a second end, the first end engaging the engagement structure of the rod structure, the second end engaging the portion of the at least one wall extending into at least one of the plurality of openings, wherein the resistance article resists rotational movement of the rod structure.

A fifth general aspect relates to a resistance training device comprising at least one wall having a plurality of openings configured to receive a rod structure, the rod structure having an engagement structure, wherein a portion of the at least one side wall radially inwardly extends into at least one of the plurality of openings, a first resistance article disposed between an inner surface of the at least one wall and an outer surface of the rod structure, the first resistance article having a first end and a second end, the first end engaging the engagement structure of the rod structure, the second end engaging the portion of the at least one wall extending into at least one of the plurality of openings, and a second resistance article disposed between the inner surface of the at least one wall and the outer surface of the rod structure, the second resistance article having a first end and a second end, the first end engaging the engagement structure of the rod structure, the second end engaging the portion of the at least one wall extending into at least one of the plurality of openings, wherein the first resistance article and the second resistance article resists rotational movement of the rod structure.

A sixth aspect relates generally to a method of providing resistance to a rotating rod structure of a game table comprising providing a mounting device, the mounting device configured to removably mount onto the game table, and a resistance article configured to be operably attached to a game table rod that extends into a game space of the game table, the resistance article having a thickness that tapers from a minimum thickness to a maximum thickness, wherein the resistance article extends through a non-uniform opening of the mounting device, wherein a resistance is gradually increased during rotation of the resistance article.

A seventh aspect relates generally to a method of providing resistance to a rotating rod structure of a game table comprising providing a game table having at least one side wall, the at least one side wall having a plurality of openings configured to receive a plurality of game table rods, and reducing a radius measured from a center point of at least one opening of the plurality of openings on only a single side of the at least one opening to make the at least one opening a non-uniform diameter opening on the at least one side wall, wherein reducing the radius creates a friction surface of the at least one side wall to provide a resistance against a movement of the game table rod.

The foregoing and other features of construction and operation will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein.

DETAILED DESCRIPTION

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1:
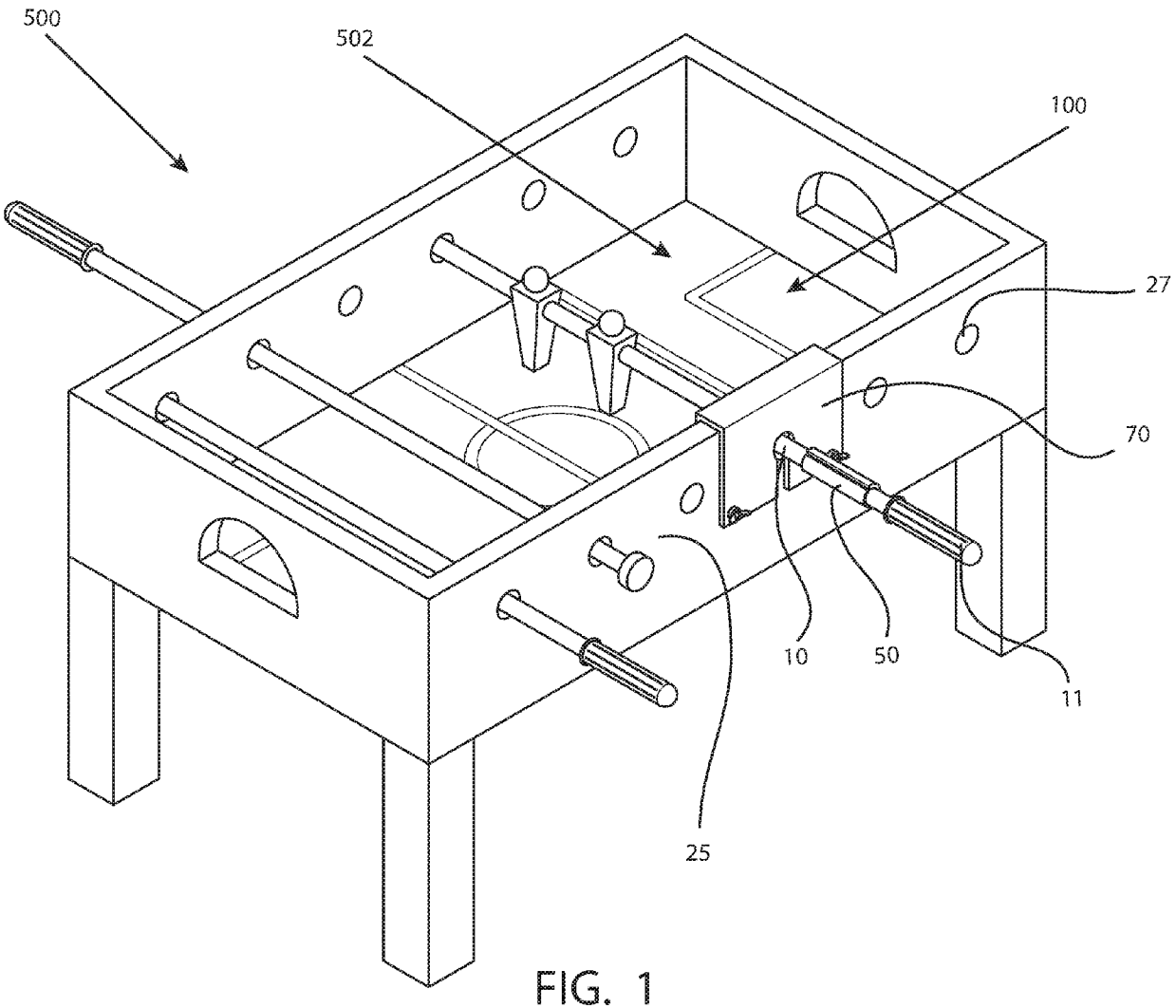
FIG. 1 depicts a perspective view of a first embodiment of a resistance training device operably attached to a game table.

Referring to the drawings, FIG. 1 depicts an embodiment of a resistance training device 100. Embodiments of the resistance training device 100 may be removably mounted on a side wall 25 of a game table 500 to increase a resistance against turning a handle 10 of a rod 15 that extends into a game space 502 of the game table 500. Embodiments of the game table 500 may include a foosball table, a hockey table, a table top hockey game, a table top foosball table, a combination game table, and the like. Embodiments of the game table 500 may include any structure that has at least one surface or wall that can cooperate with the resistance training device 100. The game table 500 may include at least one wall 325, wherein the at least one wall may be a side wall having a height. The game table 500 may have four walls, each having a height similar to the height of wall of an ordinary game table. Furthermore, embodiments of the game table 500 may include one or more openings 27, each openings configured to receive a game table rod 10 that optionally includes a handle or cover 15 at an end of the game table rod 10; embodiments of a game table rod 10 may be a rod or other bar having an axial length sufficient to extend into the game space 502 through the opening 27, and outside the game space 502 through the opening 27. Embodiments of the resistance training device 100 will be described herein with particular reference to game table 500, such as a foosball table, but embodiments of the resistance training device 100 may be used with other various applications and/or structures where resistance against the rotation or movement of an object is desired.

Embodiments of the resistance training device 100 may include a mounting device 70 and a resistance article 50. Embodiments of the resistance training device 100 may include a mounting device 70, the mounting device configured 70 to removably mount onto a game table 500, a resistance article 50 configured to be operably attached to a game table rod 10 that extends into a game space 502 of the game table 500, the resistance article 50 having a thickness, t, that tapers, wherein the resistance article 50 may extend through a non-uniform opening of the mounting device 70.

Figure 2:
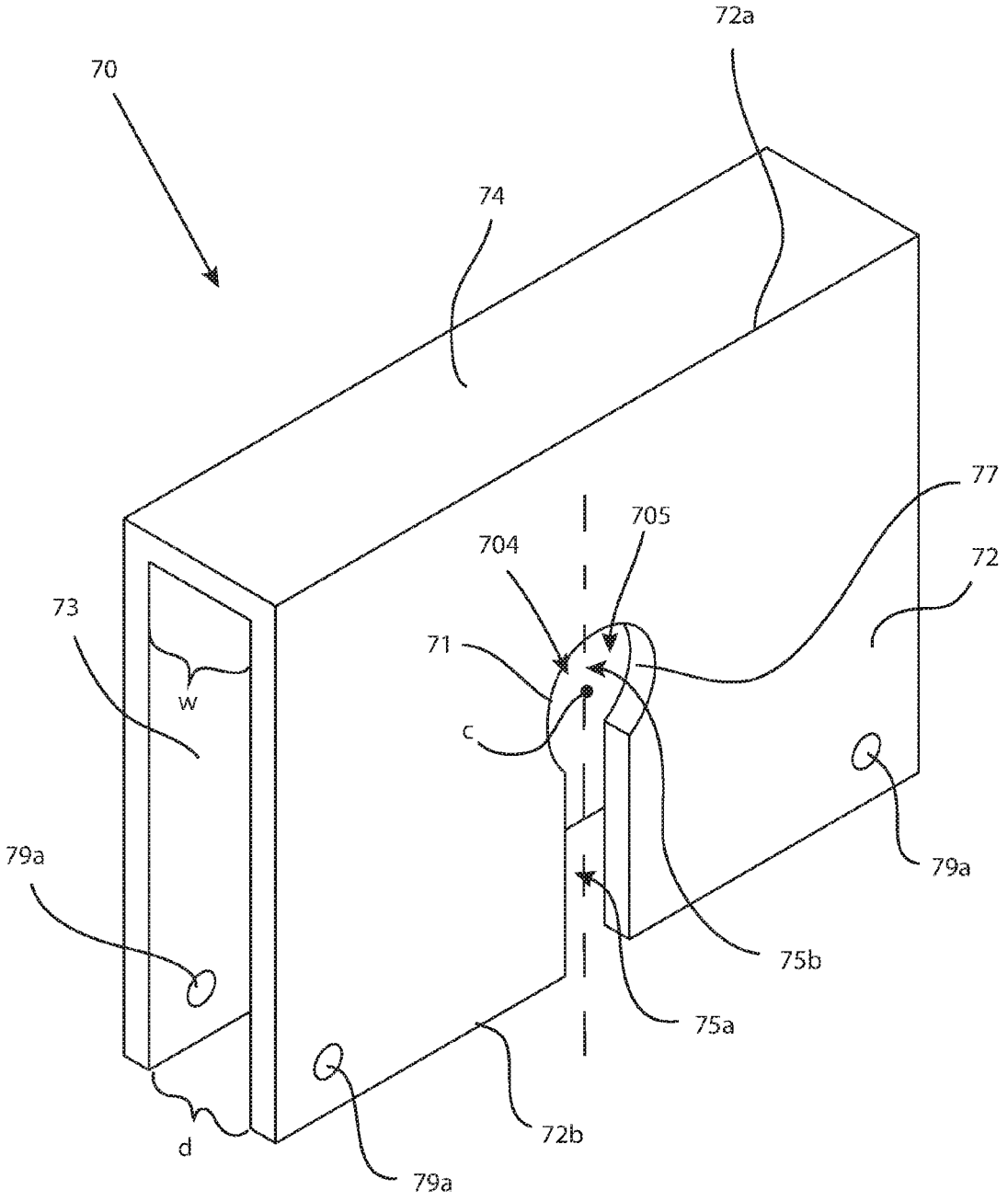
FIG. 2 depicts a perspective view of an embodiment of a mounting device.

With continued reference to FIG. 1, and additional reference to FIG. 2, embodiments of the resistance training device 100 may include a mounting device 70. Embodiments of the mounting device 70 may be operably attached to a wall 25 of a game table 500. For example, the mounting device 70 may be clamped, mounted, attached, fastened, placed onto, snapped onto, slid onto, rested on, etc., on a wall 25 of the game table 500. Embodiments of the mounting device 70 may be a mount, a clamp, a base, a support, and the like, or may be any structure capable of attachment to a side wall 25 of a game table 500, or other object. Furthermore, embodiments of the mounting device 70 may be permanently fixed to the wall 25 of the game table 500 or removably attached to the game table 500. For instance, the mounting device 70 may be permanently fastened to the game table 500 using screws, bolts, nuts, or other fastening means that may pass through and/or enter the wall 25 of the game table 500 via a plurality of fastener holes **79*a* located on the mounting device 70. Alternatively, the mounting device 70 may be removably mounted to the game table 500 through the use of mechanical interference fit, friction fit, and/or by temporary fasteners engaging the wall 25 to secure movement of the mounting device 70 with respect to the wall 25 without damaging permanently or otherwise the game table 500**.

Moreover, embodiments of the mounting device 70 may include a first side 72, a second side 73, a separation portion 74, and an elongated opening 75. The first side 72 of the mounting device 70 may be configured to be located outside the game space 502 of the game table. In other words, the first side 72 of the mounting device 70 may face the user of the game table 500. Embodiments of the second side 73 of the mounting device 70 may be configured to be located within the game space 502 of the game table 500. Embodiments of the first side 72 and the second side 73 may be separated by a distance, d. The distance, d, may be equal to, approximately equal to, or slightly larger than a thickness of the wall 25. The distance, d, between the first side 72 and the second side 73 can allow the mounting device 70 to fit over the wall 25 and receive the wall 25 as the mounting device is operably attached to the game table 500. Embodiments of the first side 72 and the second side 73 may be connected to each other by the separation portion 74. Embodiments of the separator portion 74 may span a thickness of a wall 25 of a game table 500 when the mounting device 70 is operably attached to the game table 500. For example, embodiments of the separation portion 74 may span at least a width, w, to allow operable attachment of the mounting device 70 to the game table 500. The first side 72, the second side 73, and the separation portion 74 may be structurally integral, or may be fashioned into a single component through attachment of the sides 72, 73 to the separation portion 74. Moreover, embodiments of the mounting device 70 may comprised of a plastic material, a metallic material, a composite material, an elastomeric, rubber material, or a combination thereof. The mounting device 70 may be sized and dimensioned to cooperate with walls 25 and/or game tables 500 of various sizes. For example, the mounting device 70 may be sized and dimensioned to reach the opening 27 on the wall 25.

With continued reference to FIGS. 1 and 2, embodiments of the mounting device 70 may include an elongated opening 75, or a non-uniform opening. The elongated opening 75 of the mounting device 70 may be positionable over or at least proximate the opening 27 of the wall 25 of the game table 500, and may allow movement of a game table rod 10 in vertical direction through the mounting device 70. Embodiments of the elongate opening 75 may be an opening, a hole, a void, a gap, a keyway, and the like, or any absence of material that facilitates passage of a game table rod 10 in a vertical direction. The elongate opening 75 need not be elongate to permit vertical movement of the game table rod 10 in some embodiments of the resistance training device 100. Furthermore, embodiments of the elongate opening 75 may extend from a bottom edge 72*b* towards a top edge 72*a*; some embodiments of the elongate opening 75 may extend from the bottom edge 72*b* to the top edge 72*a*. The elongated opening 75 may be on the first side 72 of the mounting device 70, and may include a first portion 75*a* and a second portion 75*b*. Embodiments of the first portion 75*a* may start at a bottom surface or edge 72*b* of the first side 72 of the mounting device 70 and may be defined by a separation or opening larger than a diameter of a game table rod 10. The first portion 75*a* of the elongated opening 75 may have a uniform width that is at least large enough to allow passage of the mounting device 70 when placing the mounting device onto the wall 25 over the game table rod 10. However, the first portion 75*a* of the elongate opening 75 may have a non-uniform width.

Moreover, embodiments of the second portion 75*b* may be defined by a rounded or curvilinear opening having a non-uniform diameter. Embodiments of the non-uniform opening 75*b* may include a first section 705 and a second section 706. Embodiments of the first section 705 may have a constant radius from a center point, C, of the non-uniform opening 75*b*, while embodiments of the second section 706 may have a smaller radius from the center point, C, than the constant radius of the first section from the center point, C. For instance, embodiments of the second portion 75*b* of the elongated opening 75 may include a friction surface 71 of the mounting device 70 created by an asymmetric opening 75*b*, wherein the friction surface 71 is closer to the center point, C, of the opening 75*b* than an opposing inner surface 77 of the mounting device 70. The distance between the center point, C, and the friction surface 71 may gradually decrease in a counter-clockwise direction. The gradual reduction in the radius of the second section 706 of the opening 75*b* (i.e. in a counter-clockwise direction towards the first portion 75*a* of the elongated opening 75) gradually increases a friction or resistance against a resistance article 50, as will be described in greater detail infra. The embodiments of the first portion 75*a* and the second portion 75*b* may represent areas of the elongate opening 75, wherein the areas are open areas, void of material.

Figures 3, 4:
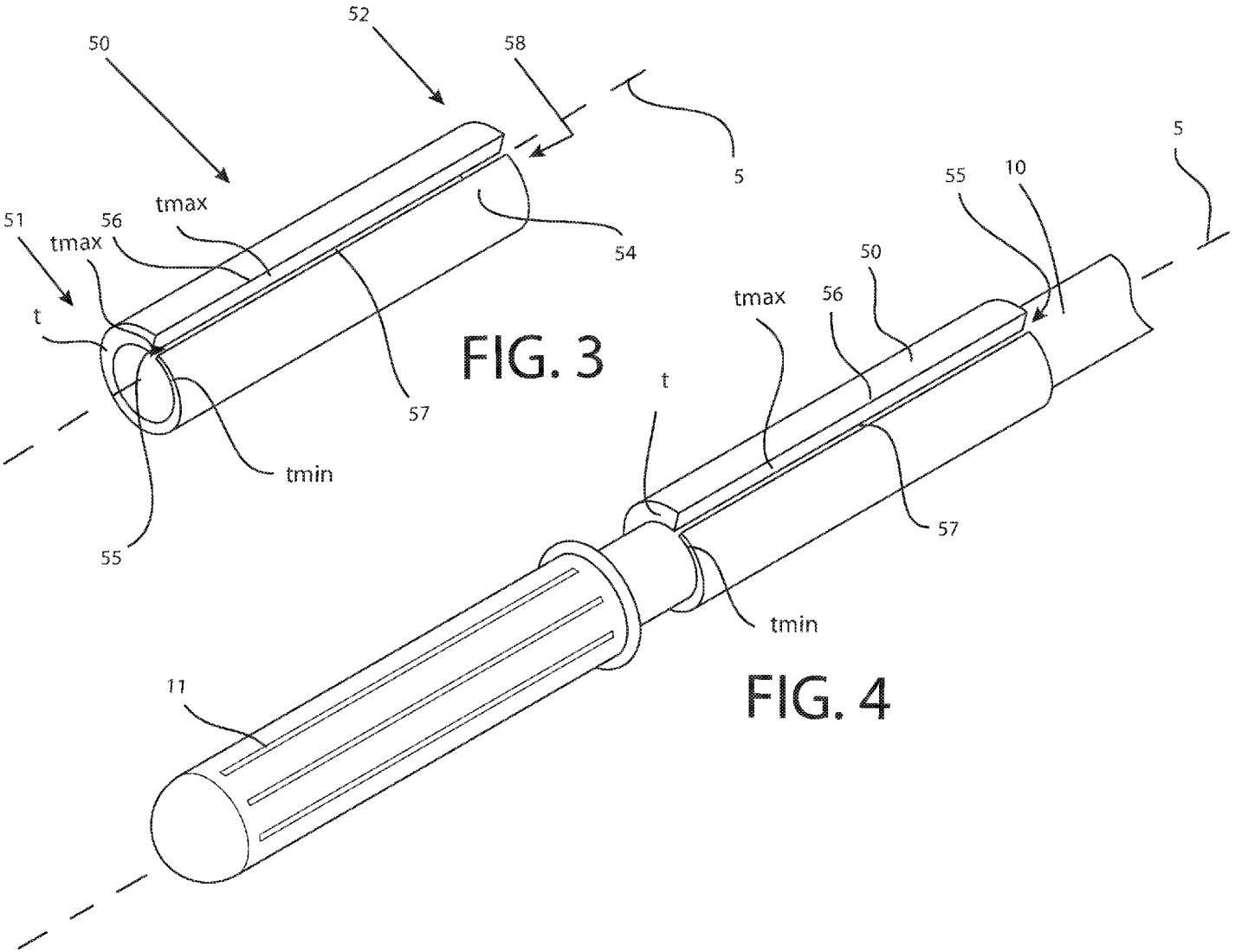
FIG. 3 depicts a perspective view of the first embodiment of a resistance article
FIG. 4 depicts a perspective view of the first embodiment of the resistance article operably attached to a first embodiment of a game table rod.

Referring still to FIG. 1, and with additional reference to FIGS. 3 and 4, embodiments of the resistance training device 100 may include a resistance article 50. Embodiments of the resistance article 50 may be configured to be operably attached to a game table rod 10 to provide a resistance against rotational movement. For instance, embodiments of the resistance article 50 may be configured to physically mechanically engage the friction surface 71 of the mounting device 70 when the resistance article 50 is rotated in a direction toward the friction surface 71. The resistance article 50 may be rotated in a clockwise or a counter-clockwise direction by rotating the game table rod 10 in a clockwise or a counter-clockwise direction. In other words, the inner surface 53 of the resistance article 50 sufficiently bonds, grips, adheres, and/or sticks to an external surface of the game table rod 10 to resist, prevent, hinder, or stop sliding between the surfaces of the resistance article 50 and the game table rod 10. The bond between the resistance article 50 and the game table rod 10 may be effectuated through static and kinetic friction components of the materials used, which allows a user to remove and replace the resistance article without leaving any residue or permanent damage to the components. Alternatively, chemical(s) and or adhesives may be used to bond the resistance article 50 to the game table rod 10. Moreover, embodiments of the resistance article 50 may be configured to wrap around, surround, grip, etc., at least a portion of the game table rod 10. Embodiments of the resistance article 50 may be a sleeve, a partial sleeve, a collar, a wrap, a pad or padding member, and the like, or any object that can wrap around a rod structure, such as game table rod 10, regardless of the cross-section of the rod structure. For example, embodiments of the resistance article 50 may conform to a curvature of the rod structure to snugly wrap around the rod structure. Furthermore, embodiments of the resistance article 50 may be conformal material resilient to respond to the friction surface 71. Embodiments of the resistance article 50 may be comprised of an elastomeric material, padding material, rubber, plastics, composite, metal(s), and/or a combination thereof. Those having skill in the art should appreciate that the resistance article 50 could be sized and dimensioned to cooperate with various sized game table rods 10.

Embodiments of the resistance article 50 of the resistance training device 100 may include a first end 51, a second end, 52, an inner surface 52, an outer surface 54, and may be a have a generally axial opening 58 therethrough between the first end 51 and the second end 52. The axial opening 58 of the resistance article 50 may receive the game table rod 10 when operably attached to the game table rod 10. Embodiments of the resistance article 50 may include a slot 55 running along an axial length of the resistance article 50. The axial slot 55 may allow the resistance article 50 to be split apart for operably attachment to a game table rod 10. For instance, the resistance article 50 may be attached to an existing, pre-assembled game table rod 10 by separating the flaps of the resistance article 50 to allow the game table rod 10 to pass through and then allow the flaps to return to the original position; the original position may be a position wherein the resistance article conforms or at least corresponds to the general shape of the game table rod 10. Furthermore, embodiments of the resistance article 50 may a thickness, t, that tapers from a minimum thickness, $t_{min}$, to a maximum thickness, $t_{max}$. For instance, the thickness, t, can be the maximum thickness, $t_{max}$, at a first edge 56 of the resistance article 50, and can be a minimum thickness, $t_{min}$, at a second edge 57. The thickness, t, of the resistance article 50 may gradually taper from the first end 56 to the second edge 57. The gradual tapering of the thickness, t, of the resistance article 50 may result in increased resistance (e.g. friction and/or interference) against rotation of the resistance article based on a physical engagement with the friction surface 71.

Figure 5:
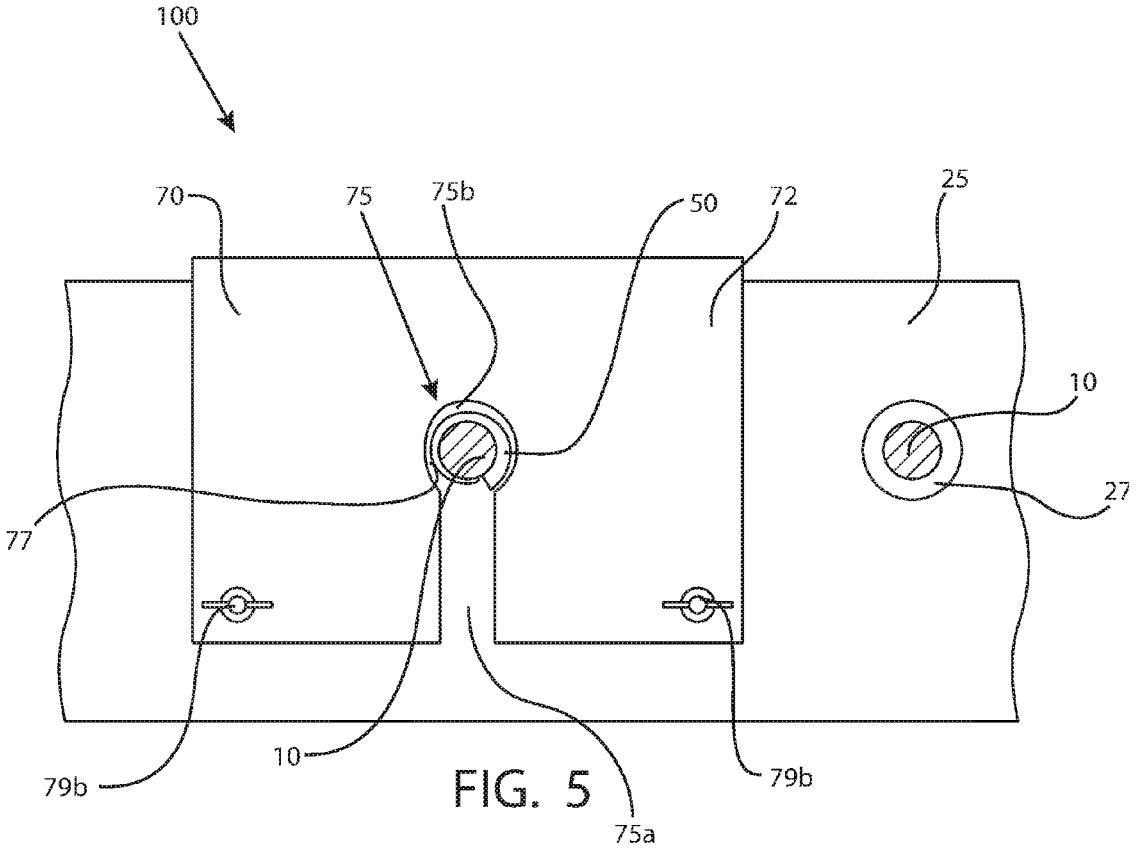
FIG. 5 depicts a side view of the first embodiment of the resistance training device operably attached to a game table, wherein the resistance article is in a first position.
Figure 6:
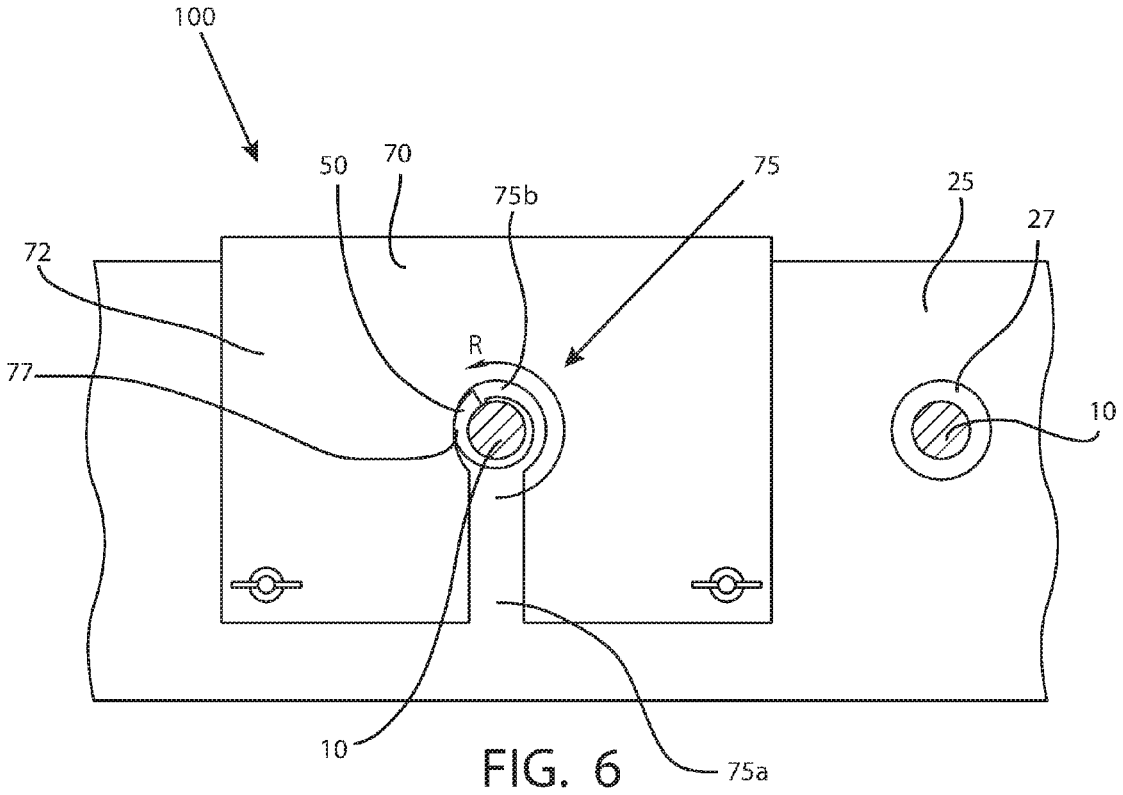
FIG. 6 depicts a side view of the first embodiment of the resistance training device operably attached to a game table, wherein the resistance article is in a second position.

With reference now to FIGS. 5 and 6, the manner in which the resistance training device 100 operates will now be described. Embodiments of the resistance training device 100 may be operably attached to a conventional game table 500, such as a foosball table. In other words, embodiments of the resistance training device 100 may be used with an existing game table 500 without requiring modifications to the game table 500. Operable attachment of the resistance training device 100 may include mounting, placing, affixing, attaching, etc., the mounting device 100 onto the wall 25 of the game table 500 at a location where the elongated opening 75 can align with a location where a game table rod 10 extends into the game space 502 through one of the plurality of openings 70 on the wall. The underside of the separator portion 74 may physically contact or be proximate to top side of the wall 25 when in the mounted position. Once fitted into position, a user may employ a plurality of fasteners **79*b* to cooperate with the plurality of fastener holes 79*a* and secure the mounting device 70 into position; however, the mounting device 70 may rely solely on an interference fit with the wall 25 of the game table 500. Operable attachment of the resistance training device 100 may further include attaching, mating, placing, wrapping, etc. the game table rod 10 with the resistance article 50. The resistance article 50 may be slid over in a sleeve-like fashion if the game table rod 10 has not been assembled as part of the game table 500, or may be wrapped around the game table rod 10 by utilizing the axial slot 55 of the resistance article 50**.

FIG. 5 depicts an embodiment of the resistance training device 100 in a first position. Embodiments of the first position may include when the resistance training device 100 has been assembled and mounted onto the game table 500. The first position may also indicate a position of rest, wherein the game table rod 10 and the resistance article 50 have not been rotated in a clockwise or a counter-clockwise direction from a center-line position; the center line position may be interpreted as a position wherein the foosmen attached to the game table rod 10 are essentially upright, and/or a position wherein a median or an approximate median of the thickness, t, of the resistance article 50 is directly above the center point, C. In this position, the resistance may not physically contact the friction surface 71.

FIG. 6 depicts an embodiment of the resistance training device 100 in a second position. Embodiments of the second position may include when the resistance article 50 physically engages the friction surface 71. Once the resistance article 50 engages the friction surface 71, rotation of the resistance article 50 and rotation of the game table rod 10 faces a resistance. The further the rod 10 is rotated in a rotational direction toward the friction surface 71 (direction R), the more resistance facing the user trying to rotate the game table 10. Accordingly, a user can practice by rotating the rod 10 to cause the resistance article 50 to engage the friction surface 71 of the mounting device which provides a resistance against the user's rotation of the rod 10. This can develop muscle memory as well as strengthen and develop the muscles themselves, such that if the resistance training device 100 is removed from the game table 500, the user will likely be able to generate a larger amount of torque on the rod 10 with less effort. Those having skill in the art should appreciate that the amount of resistance facing the user may depend on the material of the resistance article 50 and the mounting device 70, as well as the thickness of the resistance article 50.

Figure 7:
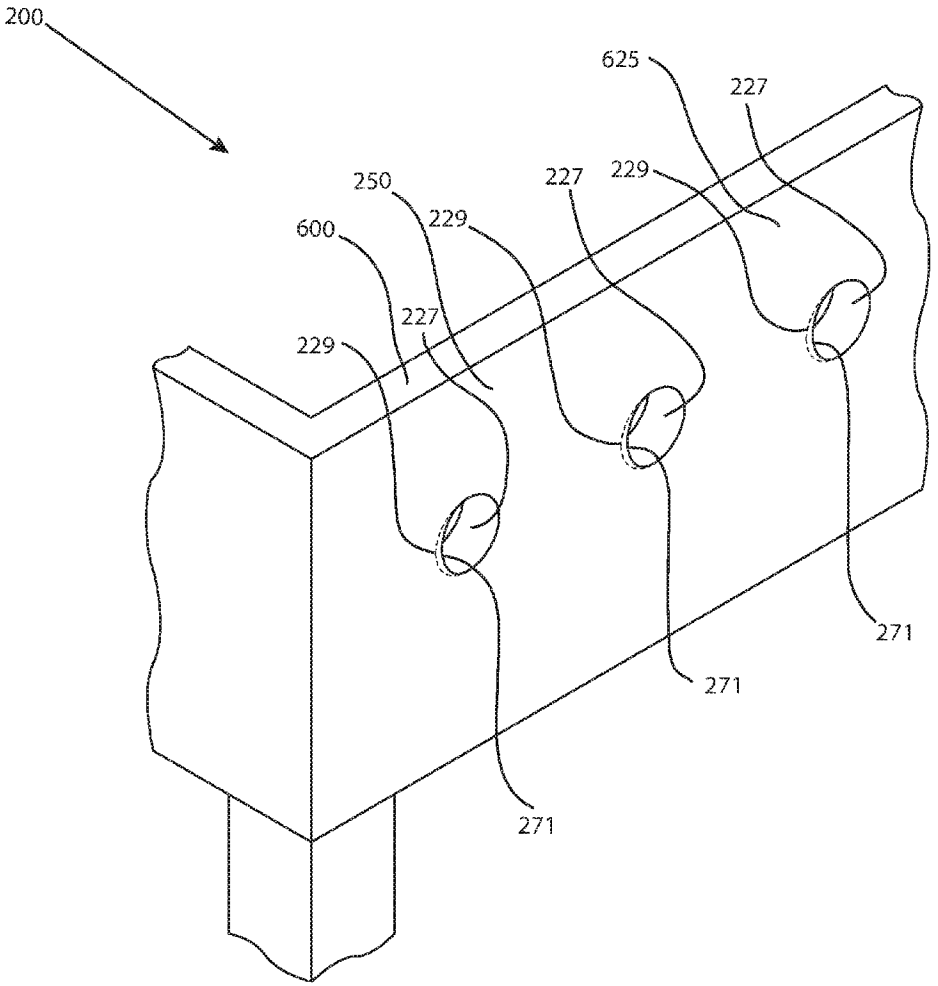
FIG. 7 depicts a perspective view of an embodiment of a game table having modified openings configured to cooperate with embodiments of the resistance article.

Referring still to the drawings, FIG. 7 depicts an embodiment of a resistance training device 200. Embodiments of the resistance training device 200 may be a game table 600 having at least one wall 325. Embodiments of the game table 600 may include a plurality of openings 227 positioned on the at least one wall 625, such as a side wall of a game table 600, wherein the openings 227 are modified or built with non-uniform diameter openings 227, as opposed to requiring the mounting device 70. Embodiments of the resistance training device 200 may be game table 600 for resistance training including a plurality of walls 625 defining a game space 602 of the game table 602, wherein at least one of the plurality of walls 625 is a side wall having a plurality of non-uniform diameter openings 227. Embodiments of the non-uniform diameter openings 227 of the side wall 325 may be defined by a rounded or curvilinear opening having a non-uniform diameter, such as the second portion **75*b* of the elongate opening 75 as described in association with the resistance training device 100. The gradual reduction in the radius of the openings 227 gradually increases a friction or resistance against a resistance article 50, as described in greater detail supra. The broken lines in FIG. 7 depict what would be a uniform diameter opening; the difference between the dashed line and the broken line can depict reduction in the radius at that location of the opening 227. Furthermore, embodiments of resistance training device 200 may include a friction surface 71, which may be the surface of the wall 625 facing the opening 227 configured to engage the external surface 54 of the resistance article to generate the resistance against movement of the rod 10. Embodiments of the resistance training device 200 may further include a plurality of game table rods extending through the plurality of non-uniform diameter openings 227**, wherein at least one foosmen may be attached to each of the plurality of game table rods, and a resistance article that may be at least partially wrapped around at least one of the plurality of game table rods.

Figure 8:
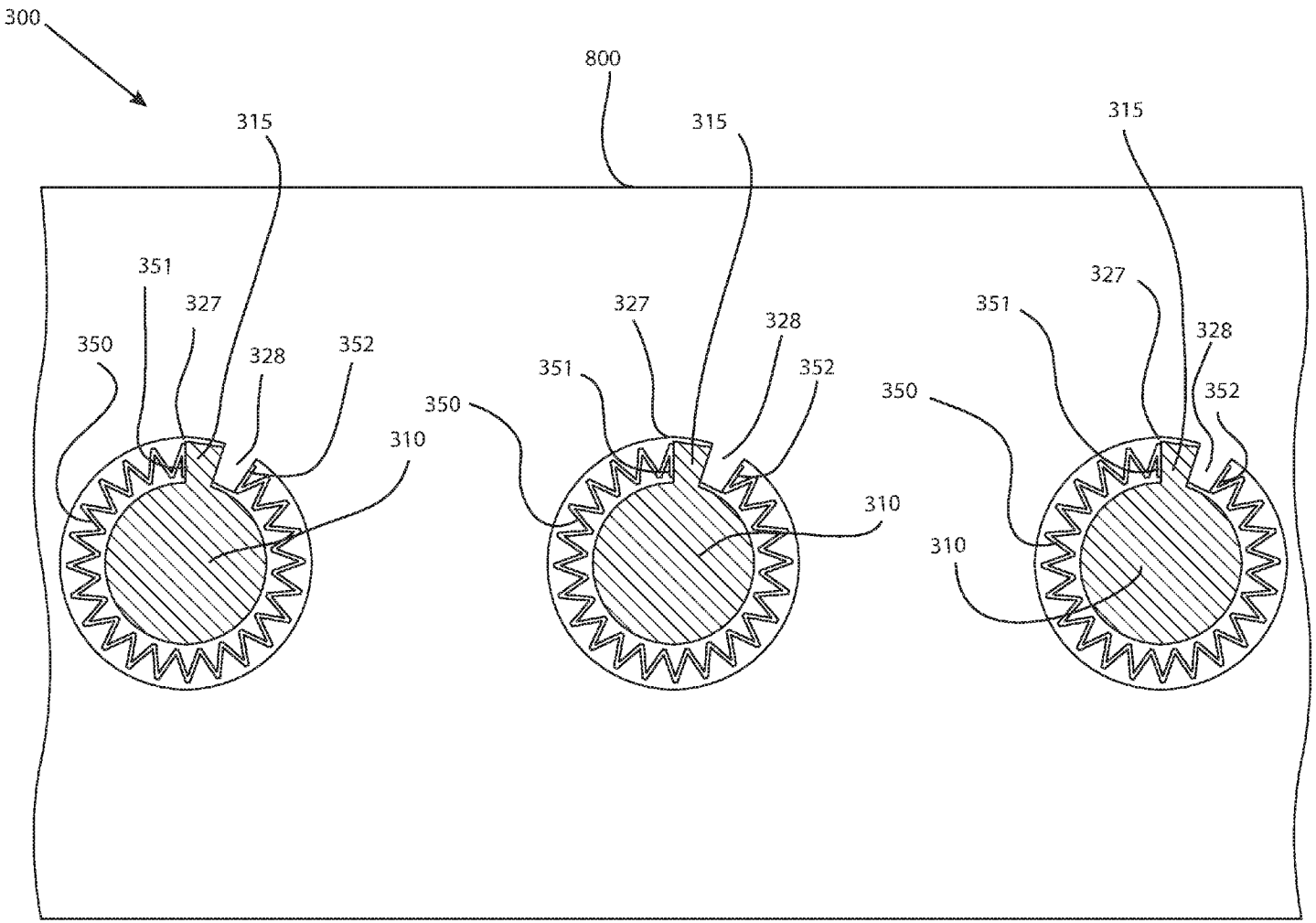
FIG. 8 depicts a side, cross-sectional view of a second embodiment of a resistance training device.
Figure 9:
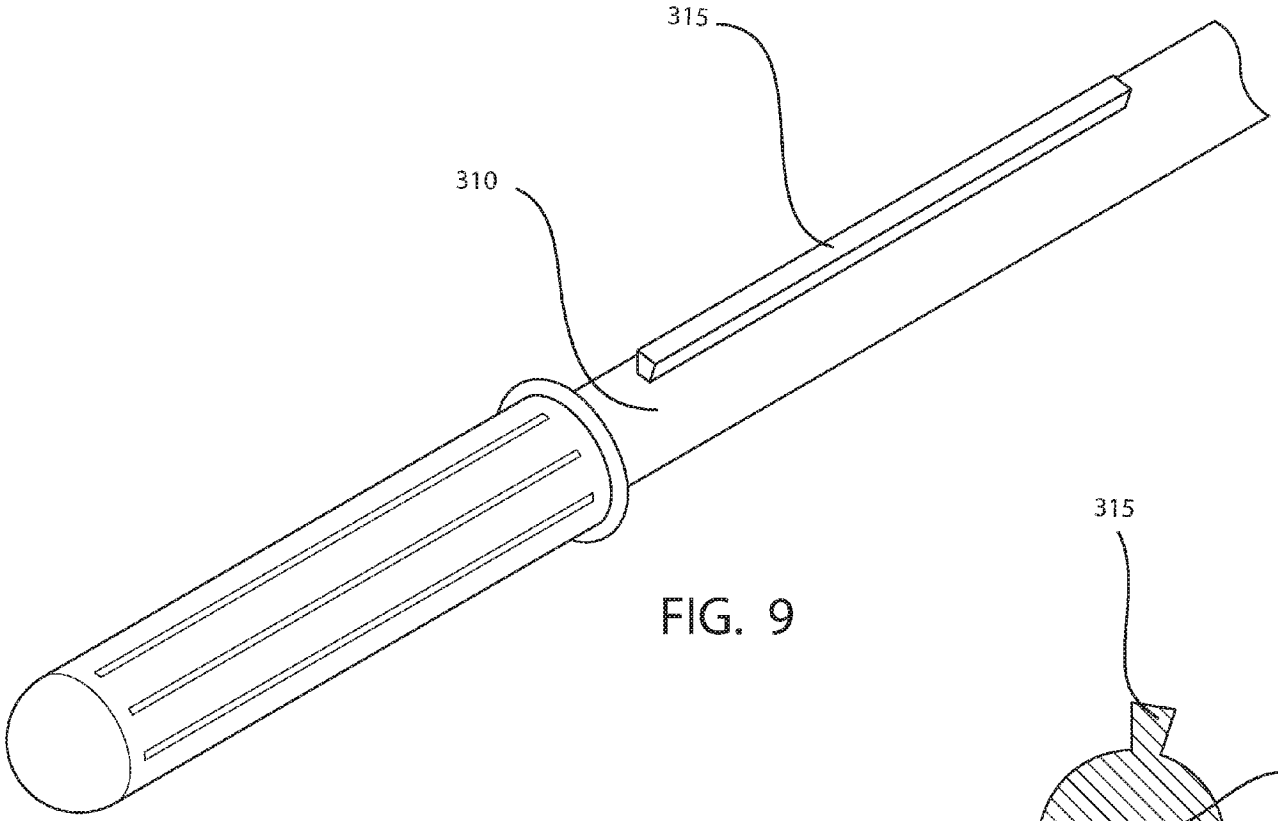
FIG. 9 depicts a perspective view of an embodiment of a game table rod having an engagement structure.
Figure 10:
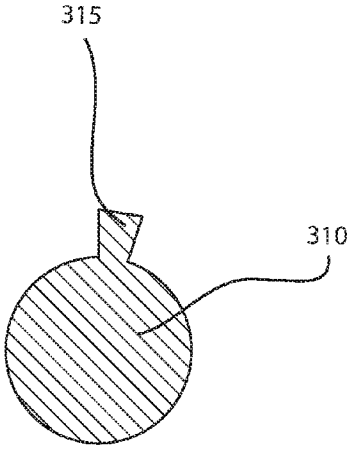
FIG. 10 depicts a cross-sectional view of an embodiment of the game table rod having the engagement structure.

Referring now to FIGS. 8-10, embodiments of a resistance training device 300 may be a game table 800 including a game table rod 310 having an engagement feature 315, and a resistance article 350 operably attached to the rod 310. Embodiments of a wall 325 of the game table 800 may include a plurality of opening 327; the plurality of openings may have a uniform or constant diameter. Embodiments of the wall 325 of game table 800 may also include a portion 328 of the at least one side wall 325 that may radially inwardly extend into at least one of the plurality of openings 227. The portion 328 of the side wall 325 may be a structurally integral portion of the wall 325 that protrudes into the opening 327; the portion 328 could be a separate component from the wall 325 that is fastened to the wall 325. Moreover, the game table rod 310 of the resistance training device 300 may share the same or substantially the same structural and functional aspects as game table 10 described in association with resistance training device 100. However, game table rod 31 may include an engagement feature 315. Embodiments of the engagement feature 315 may be a structural feature protruding from an outer surface of the game table rod 310. Embodiments of the engagement feature 315 may extend along an axial length of the game table rod 310, and may contact a resistance article 350 and the portion 328 of the wall 325 in a first position (as shown in FIGS. 8 and 11), wherein the first position is a position where resistance against rotation through operation of the resistance article is zero or approximately zero.

Furthermore, embodiments of the resistance training device 300 may further include a resistance article 350. Embodiments of the resistance article 350 may be disposed between an inner surface of the at least one wall 325 and an outer surface of a rod structure 310. The resistance article 350 may have a first end 351 and a second end 352. Embodiments of the first end 351 may engage the engagement structure 315 of the rod structure 310, and the second end 352 may engage the portion 328 of the at least one wall 325 extending into at least one of the plurality of openings 327. Embodiments of the resistance article 350 may be a spring, a compression spring, or any spring means or elastic object designed to store mechanical energy when compressed to resist the compression. Embodiments of the resistance article 350 may partially surround the rod 310 proximate or otherwise near the opening 327.

Figure 11:
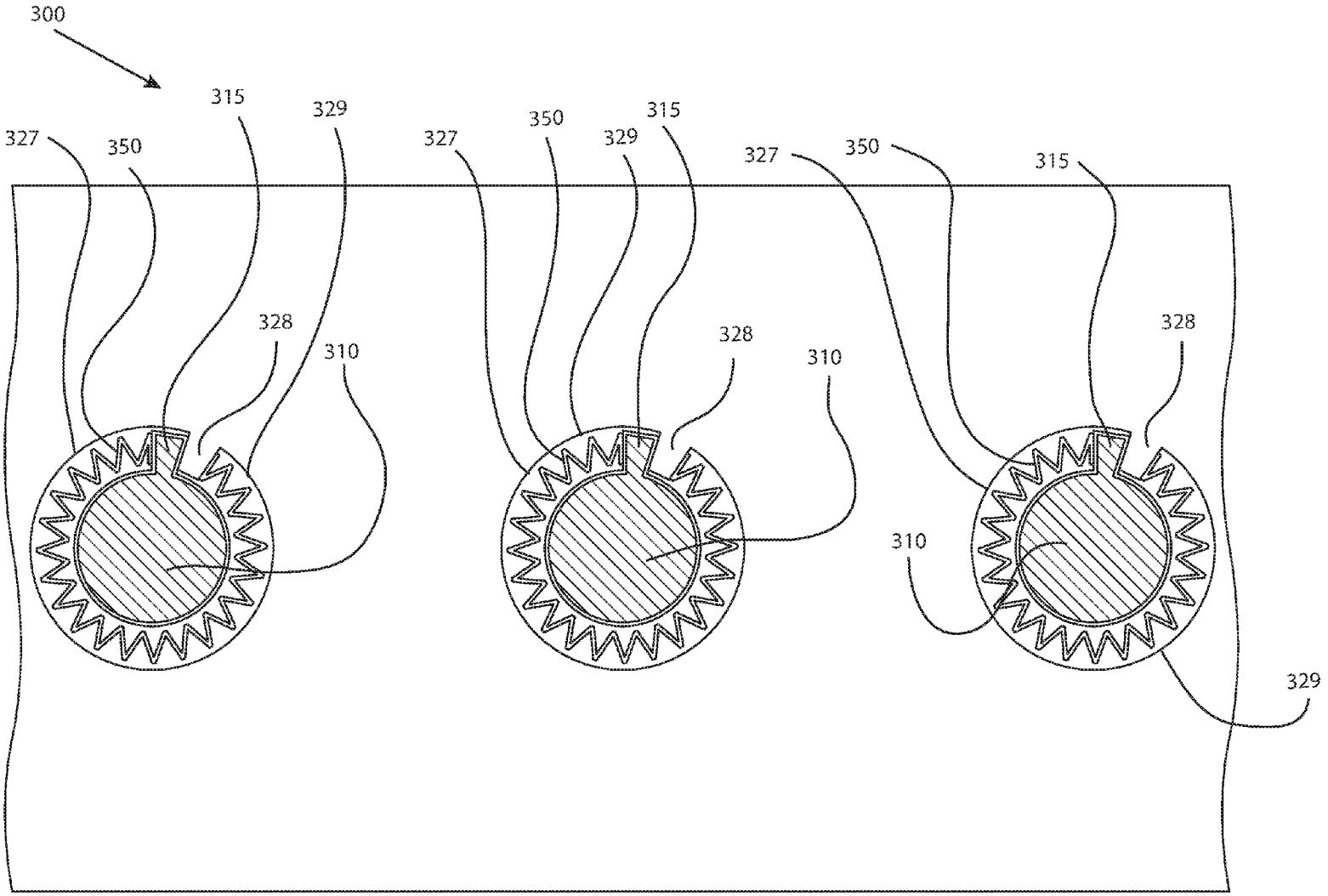
FIG. 11 depicts a side, cross-sectional view of the second embodiment of a resistance training device in a first position.
Figure 12:
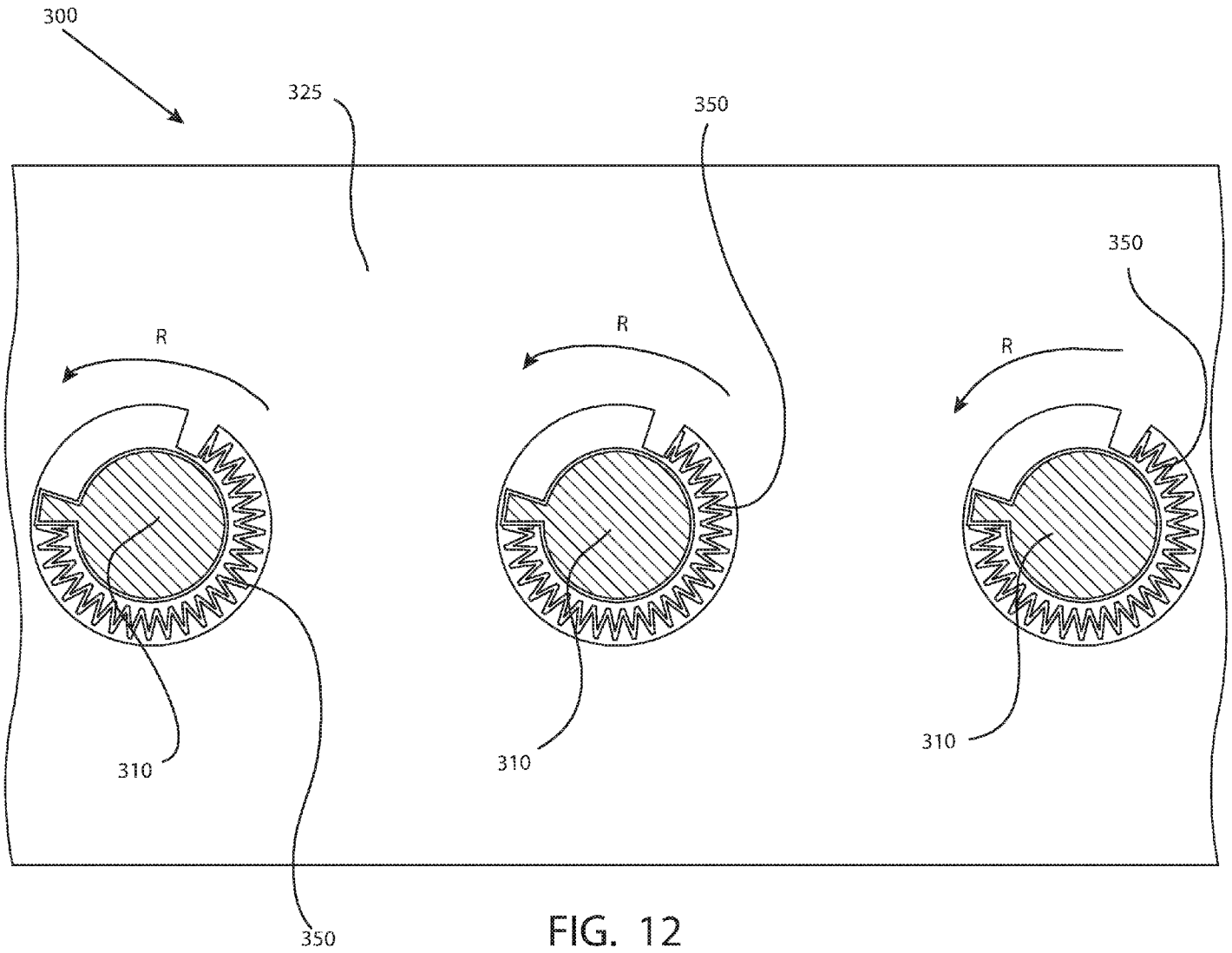
FIG. 12 depicts a side, cross-sectional view of the second embodiment of a resistance training device in a second position.

With reference now to FIGS. 11 and 12, the manner in which the resistance training device 100 operates will now be described. Embodiments of the resistance training device 3000 may provide resistance against rotational movement of the game table rod 310. FIG. 11 depicts an embodiment of the first position, wherein the engagement feature 315 contacts the portion 328 of the wall 325 without compression of the resistance article 350. If the game rod table 310 is rotated by a user in direction, R, the resistance article 350 may compress, and urge the engagement feature 315 in a direction opposite of the rotation of the game rod table 10 by the user, as shown in FIG. 12. Therefore, when the resistance article 350 biases the engagement feature 315, resistance is provided against the movement of the game table rod 310 in the second position. As the game rod table 310 is further rotated, the resistance article 350 may be further compressed, provided stronger resistance against the movement or rotation of the game rod table 310. This can develop muscle memory as well as strengthen and develop the muscles themselves, such that if the resistance training device 300 is removed from the game table 800, the user will likely be able to generate a larger amount of torque on the rod 310 with less effort. Those having skill in the art should appreciate that the amount of resistance facing the user may depend on the material properties of the resistance article 350.

Figure 13:
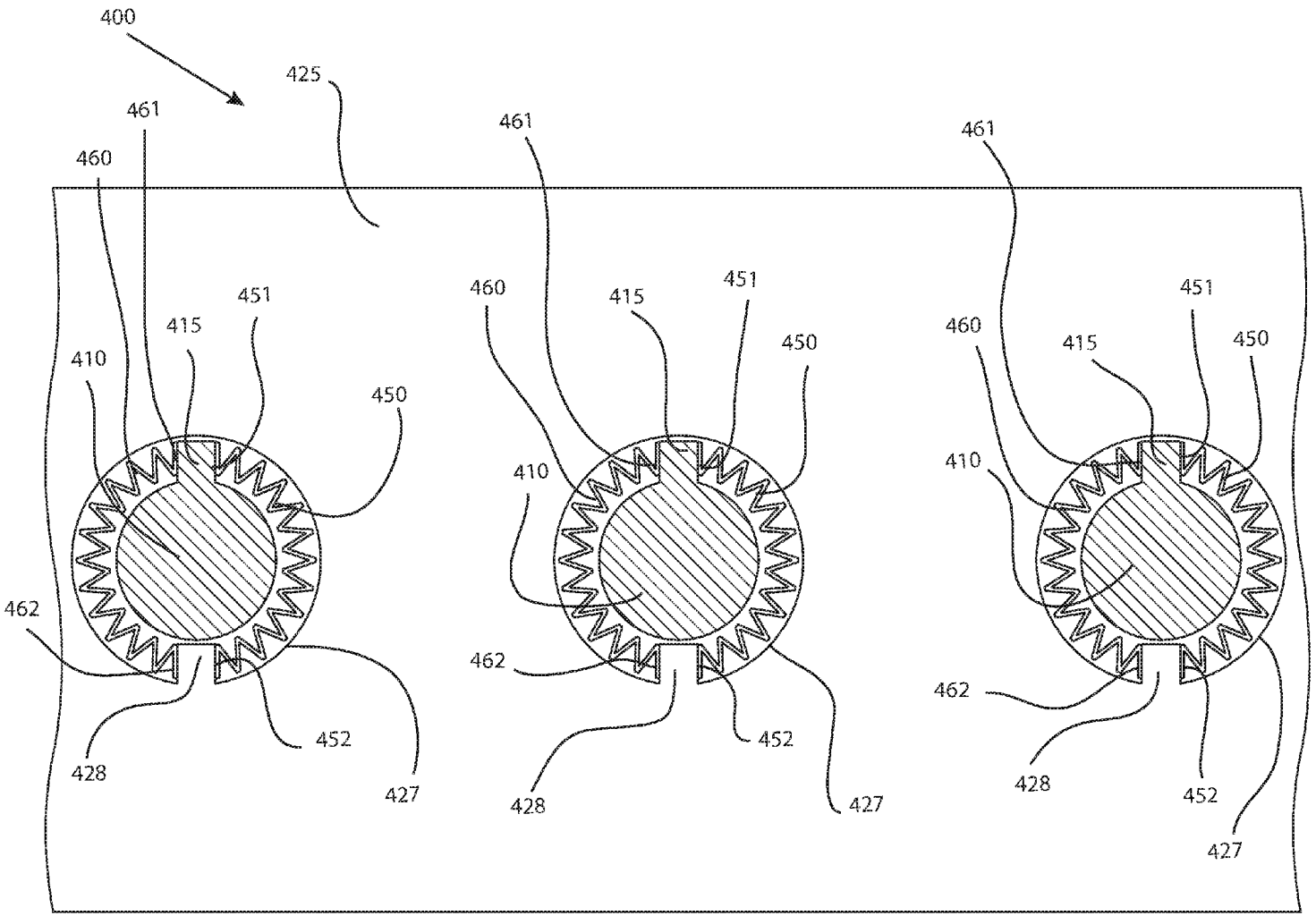
FIG. 13 depicts a side, cross-sectional view of a third embodiment of a resistance training device.

Still referring to the drawings, FIG. 13 depicts an embodiment of a resistance training device 400. Embodiments of the resistance training device 400 may share the same or substantially the same structure and function as resistance training device 300. However, embodiments of the resistance training device 400 may include first and second resistance articles 450, 460. Embodiments of the resistance training device 400 may include at least one wall 425 having a plurality of openings 427 configured to receive a rod structure 410, the rod structure 410 having an engagement structure 415, wherein a portion 428 of the at least one side wall 425 radially inwardly extends into at least one of the plurality of openings 427. Embodiments of the resistance training device 400 may further include a first resistance article 450 disposed between an inner surface of the at least one wall 425 and an outer surface of the rod structure 410, the first resistance 450 article having a first end 451 and a second end 452, the first end 451 may engage the engagement structure 415 of the rod structure 410, the second end 452 may engage the portion 428 of the at least one wall 425 extending into at least one of the plurality of openings 427, and a second resistance article 460 disposed between the inner surface of the at least one wall 425 and the outer surface of the rod structure 410, the second resistance article 460 having a first end 461 and a second end 462, the first end 461 may engage the engagement structure 415 of the rod structure 410, the second end 452 may engage the portion 428 of the at least one wall 425 extending into at least one of the plurality of openings 427. Moreover, the first end 451 of the first resistance article 450 and the first end 462 of the second resistance article 460 may engage the engagement feature 415 on opposite sides of the engagement feature 415, such that the user may receive resistance whether the rod 410 is turned to in a clockwise or a counter-clockwise direction; the resistance is similar to that as described in association with resistance device 300. Accordingly, embodiments of the first resistance article 450 and the second resistance article 460 may resist rotational movement of the rod structure 410 in opposing directions.

Referring now to FIG. 1-13, a method of providing resistance to a rotating rod structure may comprise the following steps of providing a mounting device 70, the mounting device 70 configured to removably mount onto the game table 500, and a resistance article 50 configured to be operably attached to a game table rod 10 that extends into a game space 502 of the game table 500, the resistance article 50 having a thickness, t, that tapers from a minimum thickness, $t_{min}$, to a maximum thickness, $t_{max}$, wherein the resistance article 50 extends through a non-uniform opening 75 of the mounting device 70, wherein a resistance is gradually increased during rotation of the resistance article 50. Another embodiment of a method producing resistance may include the steps of providing a game table 600 having at least one side wall 625, the at least one side wall 625 having a plurality of openings 227 configured to receive a plurality of game table rods 210; and reducing a radius measured from a center point, C, of at least one opening 227 of the plurality of openings 227 on only a single side of the at least one opening 227 to make the at least one opening 227 a non-uniform diameter opening on the at least one side wall 625, wherein reducing the radius creates a friction surface 271 of the at least one side wall 625 to provide a resistance against a movement of the game table rod 210.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the invention, as required by the following claims. The claims provide the scope of the coverage of the invention and should not be limited to the specific examples provided herein.

What is claimed is:

1. A game table for resistance training comprising:

a plurality of walls defining a game space of the game table, wherein at least one of the plurality of walls is a side wall having a plurality of non-uniform diameter openings;

a plurality of game table rods extending through the plurality of non-uniform diameter openings; and a resistance article at least partially wrapped around at least one of the plurality of game table rods, the resistance article having a tapered thickness;

wherein the non-uniform diameter openings of the side wall is defined by a first section and a second section, the first section having a constant radius from a center point of the non-uniform opening, and the second section having a smaller radius than the constant radius of the first section wherein a frictional resistance is gradually increased in the interface between the resistance article and a respective non-uniform diameter opening during rotation of the resistance article.

2. The game table of claim 1, wherein the resistance article is comprised of an elastomeric material.

3. The game table of claim 1, wherein the plurality of walls comprise a total of four walls surrounding the game space.

4. The game table of claim 1, wherein the smaller radius of the second section is not constant.

5. The game table of claim 1, wherein at least one foosmen is attached to at least one of the plurality of game table rods.

6. The game table of claim 1, wherein the game table is a foosball table.

7. A game table for resistance training comprising: a plurality of walls defining a game space of the game table, wherein at least one of the plurality of walls is a side wall having at least one opening configured to receive a rod structure, the rod structure having an engagement structure, wherein a portion of the at least one side wall radially inwardly extends into the at least one opening; and a resistance article disposed between an inner surface of the at least one side wall and an outer surface of the rod structure, the resistance article having a first end and a second end, the first end engaging the engagement structure of the rod structure, the second end engaging the portion of the at least one side wall extending into the at least one opening;

wherein the resistance article resists rotational movement of the rod structure.

8. The resistance training device of claim 7, wherein the resistance article is a spring.

9. The resistance training device of claim 7, wherein the engagement structure runs axially along the rod structure.

10. The resistance training device of claim 7, wherein the engagement structure of the rod structure is a protrusion.

11. The resistance training device of claim 7, wherein the at least one side wall comprises a side wall of a foosball table.

12. A game table for resistance training comprising: a plurality of walls defining a game space of the game table, wherein at least one of the plurality of walls is a side wall having at least one opening configured to receive a rod structure, the rod structure having an engagement structure, wherein a portion of the at least one side wall radially inwardly extends into the at least one opening;

a first resistance article disposed between an inner surface of the at least one side wall and an outer surface of the rod structure, the first resistance article having a first end and a second end, the first end engaging the engagement structure of the rod structure, the second end engaging the portion of the at least one side wall extending into the at least one opening; and a second resistance article disposed between the inner surface of the at least one side wall and the outer surface of the rod structure, the second resistance article having a first end and a second end, the first end engaging the engagement structure of the rod structure, the second end engaging the portion of the at least one side wall extending into the at least one opening;

wherein the first resistance article and the second resistance article resist rotational movement of the rod structure.

13. The resistance training device of claim 12, wherein the first resistance article and the second resistance article are springs.

14. The resistance training device of claim 12, wherein the engagement structure runs axially along the rod structure.

15. The resistance training device of claim 12, wherein the engagement structure of the rod structure is a protrusion.

16. The resistance training device of claim 12, wherein the at least one side wall comprises a side wall of a foosball table.

* * * * *